United States Patent [19]

Feklin

[11] Patent Number: 4,504,173

[45] Date of Patent: Mar. 12, 1985

[54] APPARATUS FOR CONSTRUCTING CAST IN PLACE TUBULAR PILES AND METHOD OF CONSTRUCTING SUCH PILES BY SAME APPARATUS

[75] Inventor: Valentin I. Feklin, Dnepropetrovsk, U.S.S.R.

[73] Assignee: Dnepropetrovsky Inzhenerno-Stroitelny Institut, Dnepropetrovsk, U.S.S.R.

[21] Appl. No.: 421,090

[22] Filed: Sep. 22, 1982

[30] Foreign Application Priority Data

Sep. 22, 1981 [SU] U.S.S.R. ..... 3330151
Dec. 25, 1981 [SU] U.S.S.R. ..... 3372779

[51] Int. Cl.[3] ..... E02D 5/56; E02D 15/40

[52] U.S. Cl. ..... 405/240; 405/241; 405/243

[58] Field of Search ..... 405/233, 236, 240–243, 405/253; 175/386, 388, 391; 166/290

[56] References Cited

U.S. PATENT DOCUMENTS

| | | | |
|---|---|---|---|
| 1,157,442 | 10/1915 | Stewart | 405/240 |
| 1,447,407 | 3/1923 | Blumenthal | 405/243 X |
| 1,742,926 | 1/1930 | Newton | 405/243 |
| 2,010,778 | 8/1935 | Stechert | 405/240 |
| 2,250,670 | 7/1941 | Joy | 175/388 X |
| 2,512,831 | 6/1950 | Holmes . | |
| 2,729,067 | 1/1956 | Patterson | 175/388 X |
| 3,604,214 | 9/1971 | Turzillo | 405/241 |
| 3,690,109 | 9/1972 | Turzillo . | |
| 3,869,869 | 3/1975 | Pao Chen | 405/240 |

FOREIGN PATENT DOCUMENTS

| | | | |
|---|---|---|---|
| 753106 | 10/1933 | France | 405/253 |
| 1322130 | 2/1963 | France | 405/241 |
| 649789 | 2/1979 | U.S.S.R. . | |
| 747932 | 7/1980 | U.S.S.R. . | |
| 777144 | 11/1980 | U.S.S.R. . | |

*Primary Examiner*—Cornelius J. Husar
*Assistant Examiner*—Nancy J. Stodola
*Attorney, Agent, or Firm*—Fleit, Jacobson, Cohn & Price

[57] ABSTRACT

The apparatus includes two tools for forming holes in the subsoil without excavating it, which tools being coaxially mounted on a drill column. To the end of the drill column there is attached a hollow tool which is concealed when a skirt is in a lower position and exposed when the skirt is in an upper position. A soil displacing body is mounted on the drill column and above the tool. The soil displacing body is a hollow structure and has an upper opening wherethrough its inner space communicates with a concrete feeding tube and a lower opening closable by the skirt in its upper position. To construct a tubular pile the apparatus is driven into the subsoil whereby a design hole is formed, then the apparatus is withdrawn from the hole with a simultaneous filling of the hole with a concrete mix through the concrete feeding tube, the soil displacing body, and the lower opening provided therein. A ballasting material is concurrently fed through the drill column, out of the hollow tool, and into the space defined by the skirt, which, as the apparatus is being withdrawn, assumes a lower position to conceal the hollow tool and define a hollow in the concrete that has been laid in the tube.

1 Claim, 13 Drawing Figures

APPARATUS FOR CONSTRUCTING CAST IN PLACE TUBULAR PILES AND METHOD OF CONSTRUCTING SUCH PILES BY SAME APPARATUS

BACKGROUND OF THE INVENTION

1. Field of the Invention

The present invention relates to apparatus for constructing cast in place tubular piles and to a method of constructing such piles by the same apparatus.

2. Description of the Prior Art

An application filed earlier by V. Fyoklin et al. discloses an apparatus including a drill column, a hollow soil displacing tool having a helical ribbon surface and a tip portion, the hollow soil displacing tool being provided with a tubular soil displacing body received therein and having projections on its upper portion while the same soil displacing tool being also provided with slots on its inner surface for cooperation with the projections of the tubular soil displacing body, besides the apparatus being provided with a skirt axially movable along the drill column and having an outer helical ribbon surface on its upper portion.

The prior art apparatus suffers from a disadvantage of an inadequate scope of its application as regards the construction of the cast in place tubular piles because difficulties are involved in lowering the apparatus true to center into a hole previously formed by another tool and filled with a concrete mix.

Known in the art is also a method of constructing a cast in place tubular pile, which bears closely on the invention (USSR Inventor's Certificate No. 777,144), wherein a casing is driven in the subsoil, the casing being composed of a number of concentrically spaced tubular members previously capped together and having a reinforcement arranged between the tubular members.

The prior art method, however, suffers from disadvantages as listed below:

1. A low efficiency because of difficulties in driving the casing into the subsoil due to a high resistance from the subsoil.

2. The soil is inadequately compacted and over an insufficient area about the casing to insignificantly increase bearing capacity of the casing against the subsoil.

3. The surface of the casing is not protected against the corrosive action of the subsoil water thereby the casing is rapidly destroyed.

4. The proposed method does not insure that the piles will be of acceptable quality because gravel as well as the soil is likely to get into the spacing between the tubular members, since practically the spacing cannot be reduced to a satisfactory amount.

5. A limited length of the cast in place tubular piles is due to a high soil to casing resistance.

6. A high power consumption of the construction.

The invention contemplates the provision of an apparatus for constructing cast in place tubular piles and to a method of constructing such piles by the same apparatus, which make it possible to enlarge the area and amount of the soil compaction as well as to make the construction efficiency increased.

SUMMARY OF THE INVENTION

An object of the invention is to provide an apparatus for constructing cast in place tubular piles and a method therefor, which ensure a wider scope of application of a novel apparatus.

A further object of the invention is to provide an apparatus for constructing cast in place tubular piles and a method therefor, which ensure a larger area and a greater amount of the soil compaction as well as a higher efficiency in the pile construction.

According to the invention the apparatus is provided with a hollow soil displacing body connected to a concrete feeding tube, arranged axially with the soil displacing tool, and having a cylindrical sizing portion, a lower portion defined by an outer helical ribbon surface terminating in an opening closable by the skirt, and an upper taped portion, besides, the hollow soil displacing body is immovably mounted on the drill column through a spider. The outer surface of the upper portion is tapering upward while the skirt is mounted on the drill column to transmit torque. The skirt has an axial length sufficient to conceal the soil displacing tool together with its tip portion when the skirt is in a lower position.

The invention also resides in the provision of a method of constructing cast in place tubular piles, wherein a hole is formed by the apparatus of the invention and as the same apparatus is being withdrawn the hole is filled with concrete to form a tubular pile with a hollow axially extending along a predetermined length of the pile, the step of filling hole with concrete being carried out ahead of the step of forming a hollow in the concrete that has been laid in the hole, and in order to protect the pile against corrosion an outer shell is simultaneously formed by displacing a corrosion resistant material into the hole wall by the same apparatus, which material being fed into the hole mouth.

An alternative way of practicing the method consists in that a corrosion resisting material is fed into the hole mouth simultaneously with the step of withdrawing the apparatus from the hole and displaced into the side walls of the hole by the same apparatus as it is withdrawn from the hole.

DETAILED DESCRIPTION OF THE INVENTION

Figure 1:
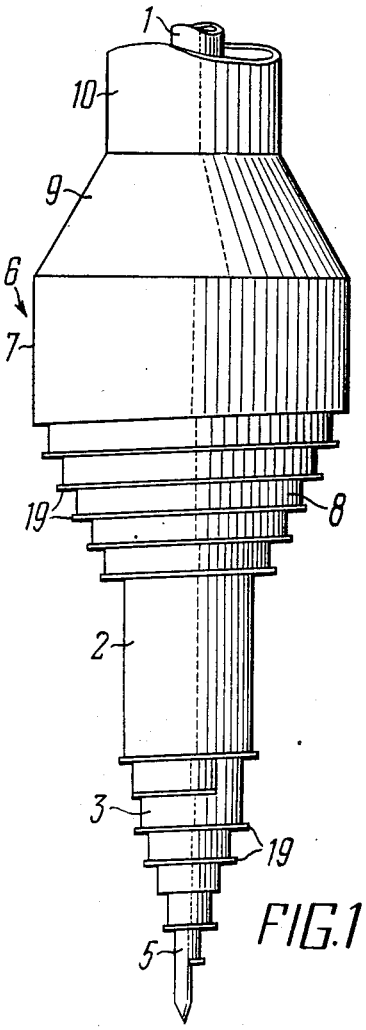
FIG. 1 is a general view of the apparatus.
Figure 2:
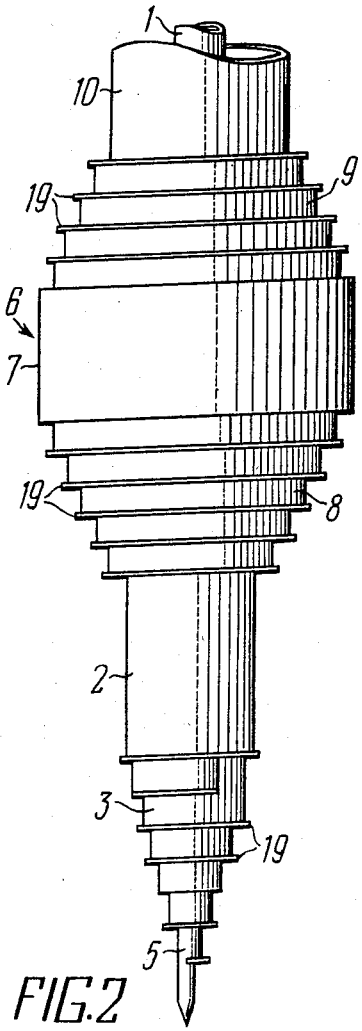
FIG. 2 is a view similar to that in FIG. 1 but representing an outer helical ribbon surface of the upper tapered portion.
Figure 3:
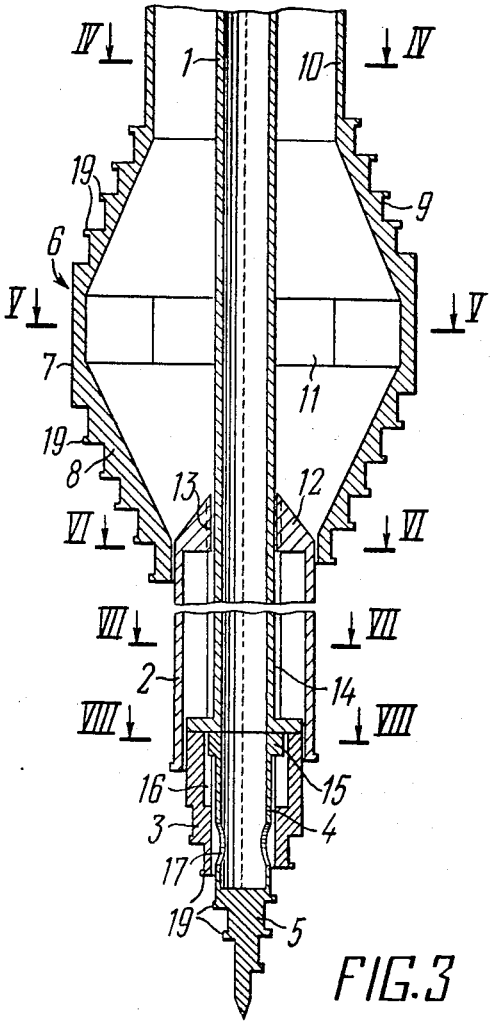
FIG. 3 is a longitudinal section through the apparatus in the position of forming a hole.
Figure 4:
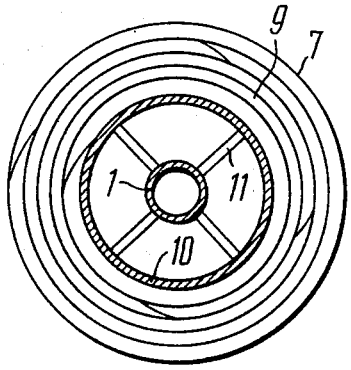
FIG. 4 is a sectional view taken on the line 4—4 of FIG. 3.
Figure 5:
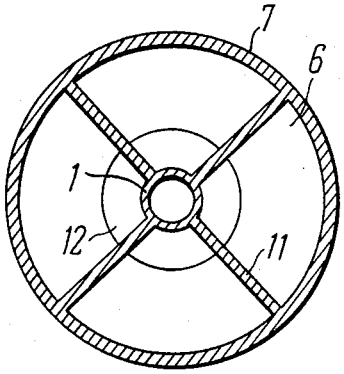
FIG. 5 is a sectional view taken on the line 5—5 of FIG. 3.
Figure 6:
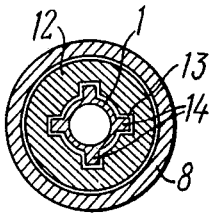
FIG. 6 is a sectional view taken on the line 6—6 of FIG. 3.
Figure 7:
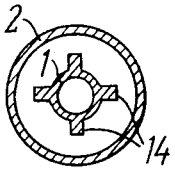
FIG. 7 is a sectional view taken on the line 7—7 of FIG. 3.
Figure 8:
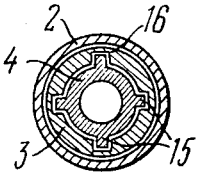
FIG. 8 is a sectional view taken on the line 8—8 of FIG. 3.
Figure 9:
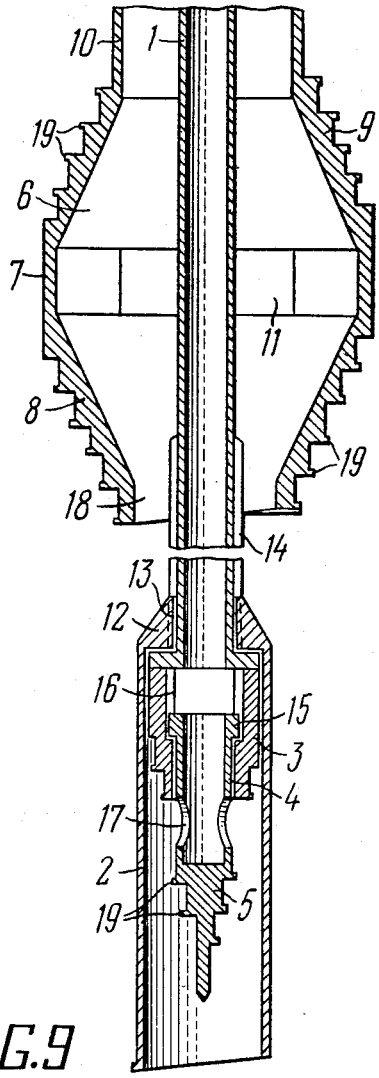
FIG. 9 is a longitudinal section through the apparatus in the position of feeding a concrete mix and a ballasting filler into the hole.

Referring to FIGS. 1–3, the apparatus for constructing cast in place tubular piles includes a helical tool assembly mounted on a drill column 1 and comprising a hollow skirt 2, a soil displacing tool 3 wherein a tubular soil displacing body 4 having a tip portion 5 is arranged. Above the soil displacing tool 3 there is a hollow soil displacing body 6 mounted on the drill column 1 and having cylindrical sizing portion 7, a lower tapered portion 8 having an outer helical ribbon surface and terminating in an opening, and an upper tapered portion 9 connected to a concrete feeding tube 10 (FIG. 4) containing the drill column 1 coaxially arranged within the tube 10. The upper tapered portion may have an outer helical ribbon surface. The drill column 1 is rigidly secured to the cylindrical portion 7 inside the hollow soil displacing body 6 with the help of a spider 11 (FIGS. 4 and 5). The hollow soil displacing body 6 is arranged coaxially with the soil displacing tool 3. The skirt 2 at its upper portion where it is joined with the drill column 1 is provided with a hollow cone 12 having inner slots 13 (FIG. 6) coacting with longitudinal ribs 14 provided on the outer surface of the drill column 1 for transmitting torque and for axial movement. The tubular soil displacing body 4 is associated with the soil displacing tool 3 through radial projections 15 received in slots 16 (FIG. 8) provided on the soil displacing tool 3 whereby the tubular soil displacing body 4 is movable along the slots 16. The tubular soil displacing body 4 has an inner diameter equal to that of the drill column 1. The body 4 at its lower portion is provided with pouring ports 17. The slots 16 limit the movement of the body 4 and provide a means for opening and closing the pouring ports 17 as well as prevent rotation of the body 4 about the soil displacing tool 3 during the formation of the hole. When the skirt is in its upper position (FIG. 3) it closes the through opening 18 in the lower tapered portion 8. Rotation of the skirt 2 about the longitudinal axis of the apparatus is precluded by the longitudinal ribs 14 received in the slots 13. When the skirt 2 is in its lower position (FIG. 9) it conceals the helical ribbon surface of the tool 3, the skirt 2 being of the length exceeding that of the tool 3 with the tip portion 5 in an extended position. When the skirt 2 is in its lower position the through opening 18 is open. The helical ribbon surfaces of the tool 3, the tip portion 5, and the tapered portions 8 and 9 of the soil displacing body 6 have collars or vanes 19 providing a means for the apparatus to screw it into the subsoil during the formation of a hole 20.

Figure 10:
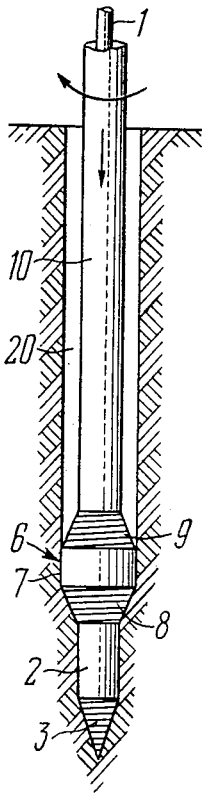
FIG. 10 is a view of a hole in the process of its formation.

The method of the invention and the novel apparatus are put to use as follows. The drill column 1 together with the concrete feeding tube 10 both rigidly interconnected are rotated with a simultaneous axial thrust, whereby the hole 20 (FIG. 10) is formed, which is also ensured by the helical ribbon surfaces and the vanes 19 provided on the tool 3, the tip portion 5, and the lower tapered portion 8 of the soil displacing body 6. At the time of hole formation the skirt 2 is tightly held in its upper position (FIG. 3) and rotation thereof about the longitudinal axis is checked by the slots which are in gear with the longitudinal ribs 14. With the skirt 2 being held in the upper position, the through opening 18 in the body 6 is closed and the soil will not get into the body 6. The lowermost edges of the skirt 2 in this position coincide or are in register with the helical ribbon surfaces of the tool 3. The tubular body 4 is retracted and the pouring ports 17 are closed.

Figure 11:
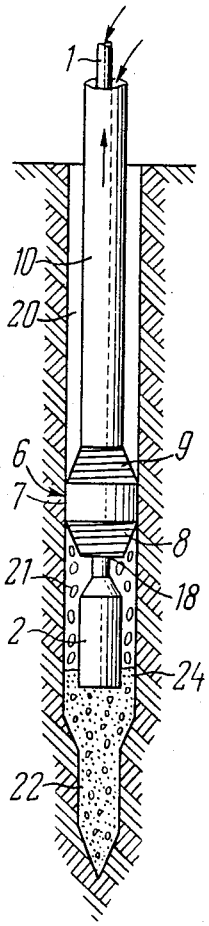
FIG. 11 is the initial stage of forming a tubular pile in the hole.
Figure 12:
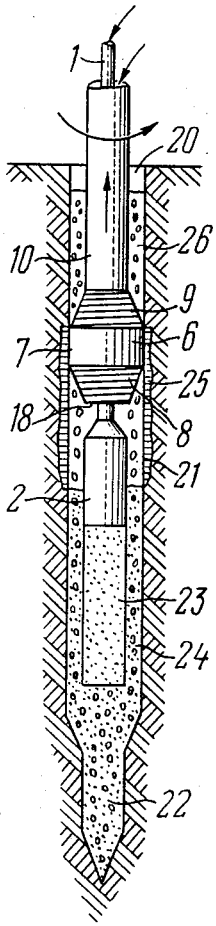
FIG. 12 shows the process of forming a concrete tubular pile and filling the pile hollow with a ballasting.
Figure 13:
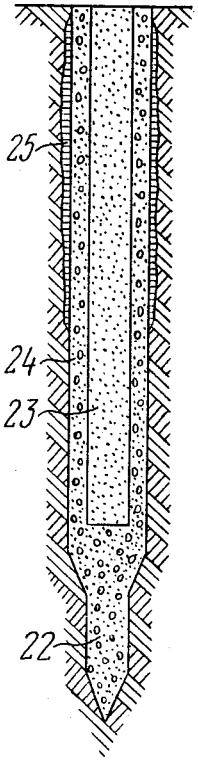
FIG. 13 is a view of a completed tubular pile.

With the hole 20 completed a concrete mix 21 is supplied through the tube 10 and into the body 6. Then the apparatus is raised a predetermined amount (FIG. 11) and the concrete mix 21 forces the skirt 2 (gravity forces are also considered) into a lower position to let the concrete mix 21 flow through opening 18 into the hole 20 thus providing a bottom portion 22 of the tubular pile and further on as the apparatus is withdrawn from the hole the concrete mix 21 flows through the tube 10 while a filler material 23 flows through the drill column 1. The filler material 23 may include dry or water-saturated sand, a mortar containing clay and weighting additives and other suitable materials. The filler 23 forces the body 4 to slide along the slots 16 into its extended position whereby the pouring ports 17 are opened and the filler 23 flows in the hollow of the pile. In this case the skirt serves as a molding means which defines the walls 24 of the tubular pile and holds the filler 23 within the hollow thus formed. As the concreting process and the placing of the filler 23 continue the skirt 2 together with the apparatus ascends. The skirt 2 holds the concrete mix 21 from intermixing with the filler 23 as they are fed into the hole. If it is desired to provide protective shells 25 on the outside of the tubular pile, a suitable material 26 (FIGS. 12 and 13) is fed into the hole as the apparatus is withdrawn. Such material may be bituminous concrete, a compound based on a synthetic binder and the like. In this case the apparatus is raised by rotating the same. The material 26 is displaced into the hole walls by the helical ribbon surfaces of the tapered portion 9 of the body 6. In order to prevent raising of the material 26 from the hole 20 its layer should be not less than 3 m, although this value can be corrected while constructing the first pile. This correction is necessary in view of various diameters of the piles, the thickness of the walls, the taper of the tool and the characteristics of the materials used.

The inner diameter of the skirt 2 is found from the formula $$d_i = D_p - 2\delta,$$

where $D_p$ is the diameter of the tubular pile;

$\delta$ is the thickness of the wall 22 of the pile.

Utilization of the novel apparatus provides for an improvement in the adaptability to the process of the construction of the cast in place tubular piles in the soil including loose and water-saturated soils resulting in mud flows when the conventional method of forming holes is utilized. The processes of forming holes and constructing the piles are brought into coincidence and the hollow is true to center.

The pile bearing capacity is improved because the piles are constructed in the holes having compacted walls.

The apparatus makes it possible to construct tubular piles in protective outer shells such as corrosion resistant shells.

The corrosion resistant materials may be bituminous concrete of various grades, various bituminous compounds based on polymeric materials.

Cast in place tubular piles may have through hollows. In this case the hollow is filled with the ballast material from the bottom.

An increase in the area and the amount of soil compaction around the pile is due to the fact that the pile has a cross-sectional area equal to that of the hole and the soil is not excavated but displaced radially of the hole. Also, an additional increase in the area and the amount of soil compaction is achieved due to the provision of the outer shell which is produced by displacing a corrosion resistant material into the hole walls.

The service life of the cast in place tubular pile in a corrosive medium is extended due to the outer corrosion resistant shell.

The efficiency is improved due to coincidence of the steps of hole forming, casting concrete to produce a pile and making an outer corrosion resistant shell while the apparatus is in the hole. The process of constructing a tubular pile is carried out continuously.

Furthermore, the hollow in the pile is formed before the concrete sets since the concrete wall will not collapse because the filler is fed into the hollow as soon as it is formed.

The efficiency is 40 to 65% higher than that of the conventional methods.

What is claimed is:

1. An apparatus for constructing cast in place tubular piles comprising:

a hollow drill column having an end portion and an inner space defining a passageway for a first material;

a hollow soil displacing body immovably mounted on said drill column and having a cylindrical sizing portion, a lower tapered portion having an outer helical ribbon surface terminating in a first opening of a predetermined diameter, and an upper tapered portion terminating in a second opening;

a feeding tube attached to said upper tapered portion around the second opening of said soil displacing body and laterally spaced from and surrounding said drill column to define a passageway for a second material;

a hollow tapered soil displacing tool having an outer helical ribbon surface and an inner space, said displacing tool attached to the end portion of said drill column below said soil displacing body so that the inner space of said displacing tool communicates with the inner space of said drill column;

a tubular soil displacing body having a tip portion and a pouring port wherethrough the inner space thereof communicates with the hole being formed in the subsoil and of said drill column and arranged within said soil displacing tool for axial movement between an extended position to open the pouring port and a retracted position to close the pouring port with said soil displacing tool;

a skirt axially movable along said drill column between a lower position to enclose said soil displacing tool and an upper position to expose said soil displacing tool and to close the first opening in said hollow soil displacing body.

* * * * *